US006330760B1

(12) United States Patent
Wolgast

(10) Patent No.: US 6,330,760 B1
(45) Date of Patent: Dec. 18, 2001

(54) PROMOTIONAL PRODUCT

(76) Inventor: Ralph J. Wolgast, 7 Misty Ridge Cir., Kinnelon, NJ (US) 07405

( * ) Notice: Subject to any disclaimer, the term of this patent is extended or adjusted under 35 U.S.C. 154(b) by 0 days.

(21) Appl. No.: 09/377,528

(22) Filed: Aug. 19, 1999

(51) Int. Cl.[7] ..... G09F 3/00
(52) U.S. Cl. ..... 40/324; 40/307; 40/310
(58) Field of Search ..... 40/306, 307, 310, 40/311, 324; 215/365; D20/19, 42

(56) References Cited

U.S. PATENT DOCUMENTS 2,219,834 * 10/1940 Davis ..... 40/324 X
2,298,769 * 10/1942 Kirchner et al. ..... 40/310
2,325,710 * 8/1943 Schweitzer ..... 40/324 X
2,398,471 * 4/1946 Short et al. ..... 60/641.6
2,731,751 * 1/1956 Green ..... 40/324 X
4,483,622 * 11/1984 Muhi et al. ..... 40/324 X
5,581,921 * 12/1996 Hutchens ..... 40/324
5,729,922 * 3/1998 Peterson et al. ..... 40/324

* cited by examiner

*Primary Examiner*—Brian K. Green
*Assistant Examiner*—James M Hewitt
(74) *Attorney, Agent, or Firm*—Alfred C. Hill

(57) ABSTRACT

A promotional product including a figurine capable of balancing on a food container or a beverage drinking vessel adjacent a top thereof, the figurine being custom made to balance on each different type of a food container or a beverage drinking vessel and being a representation of one of a group including a person, an animal, an object and a cartoon character.

10 Claims, 4 Drawing Sheets

PROMOTIONAL PRODUCT

BACKGROUND OF THE INVENTION

The present invention relates to promotional products and more particularly to a promotional product associated with a beverage drinking vessel or food container identified by the trademark DRINKTOYZ.

It is well known in the promotional business to employ many different products for advertising and promoting either a product, a company, an establishment, or a beverage. Some of these products are pencils, pens, buttons, a drinking vessel and other similar products.

SUMMARY OF THE INVENTION

An object of the present invention is to provide a novel promotional product that may be balanced on a beverage drinking vessel or food container.

Another object of the present invention is to provide a figurine that may be a representation of a person, an animal, an object or a cartoon character that is engineering and cost efficient and may be balanced on a beverage drinking vessel or food container.

A feature of the present invention is the provision of a promotional product comprising a figurine capable of balancing on one of the group consisting of a beverage drinking vessel and a food container adjacent a top thereof, the figurine being custom made to balance on each different type of beverage drinking vessel and food container, the figurine being a representation of one of the group consisting of a person, an animal, an object and a cartoon character.

Another feature of the present invention is the provision of at least one smooth surface on the figurine upon which one of the group consisting of a logo, a slogan, a tag line, a message, a beverage name, a food name, a company name and an establishment name can be imprinted.

BRIEF DESCRIPTION OF THE DRAWING

Above-mentioned and other features and object of the present invention will become more apparent by reference to the following description taken in conjunction with the accompanying drawing, in which.

DESCRIPTION OF THE PREFERRED EMBODIMENT

Figure 1:
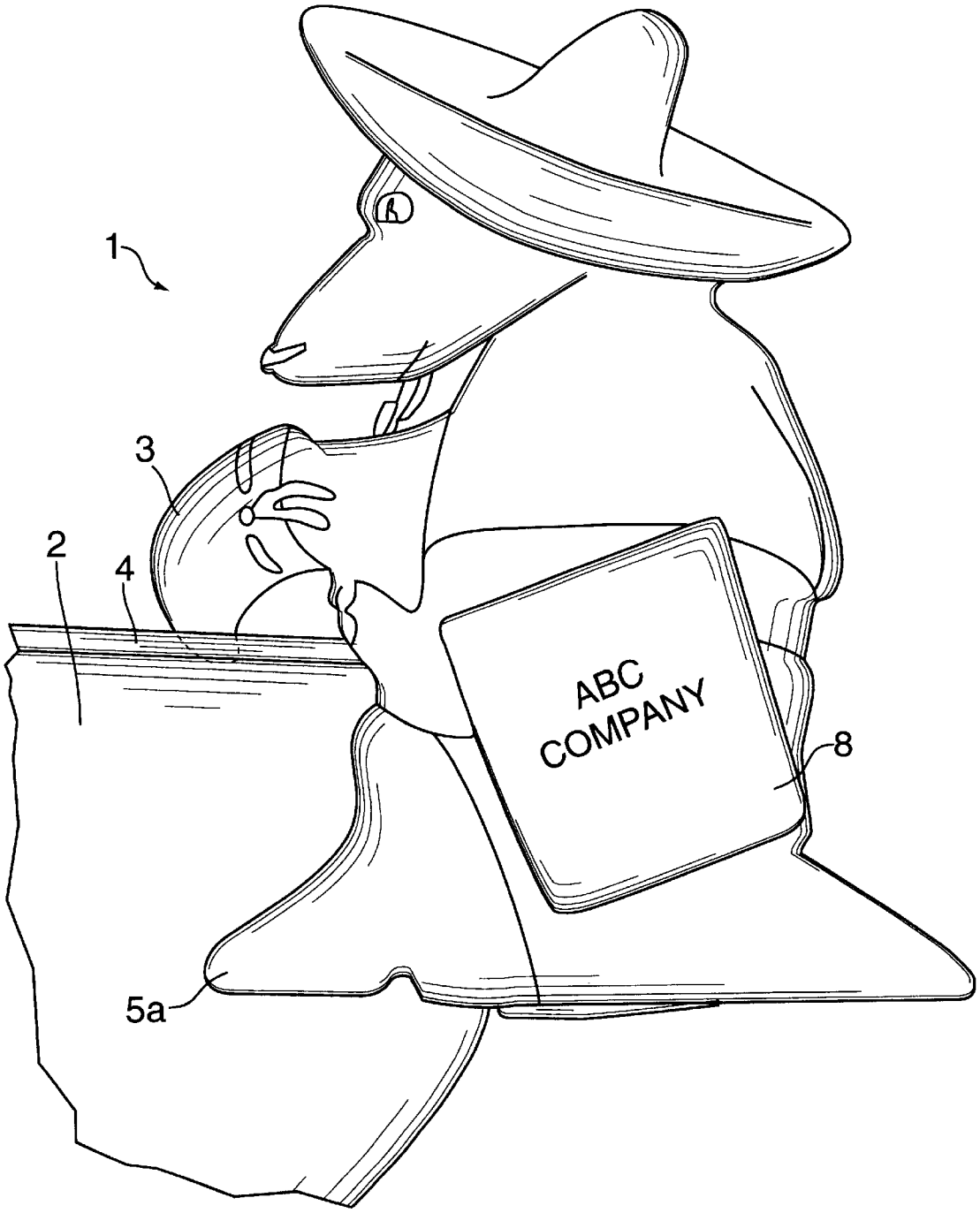
FIG. 1 is a side perspective view of one embodiment of the figurine in accordance with the principles of the present invention.
Figure 2:
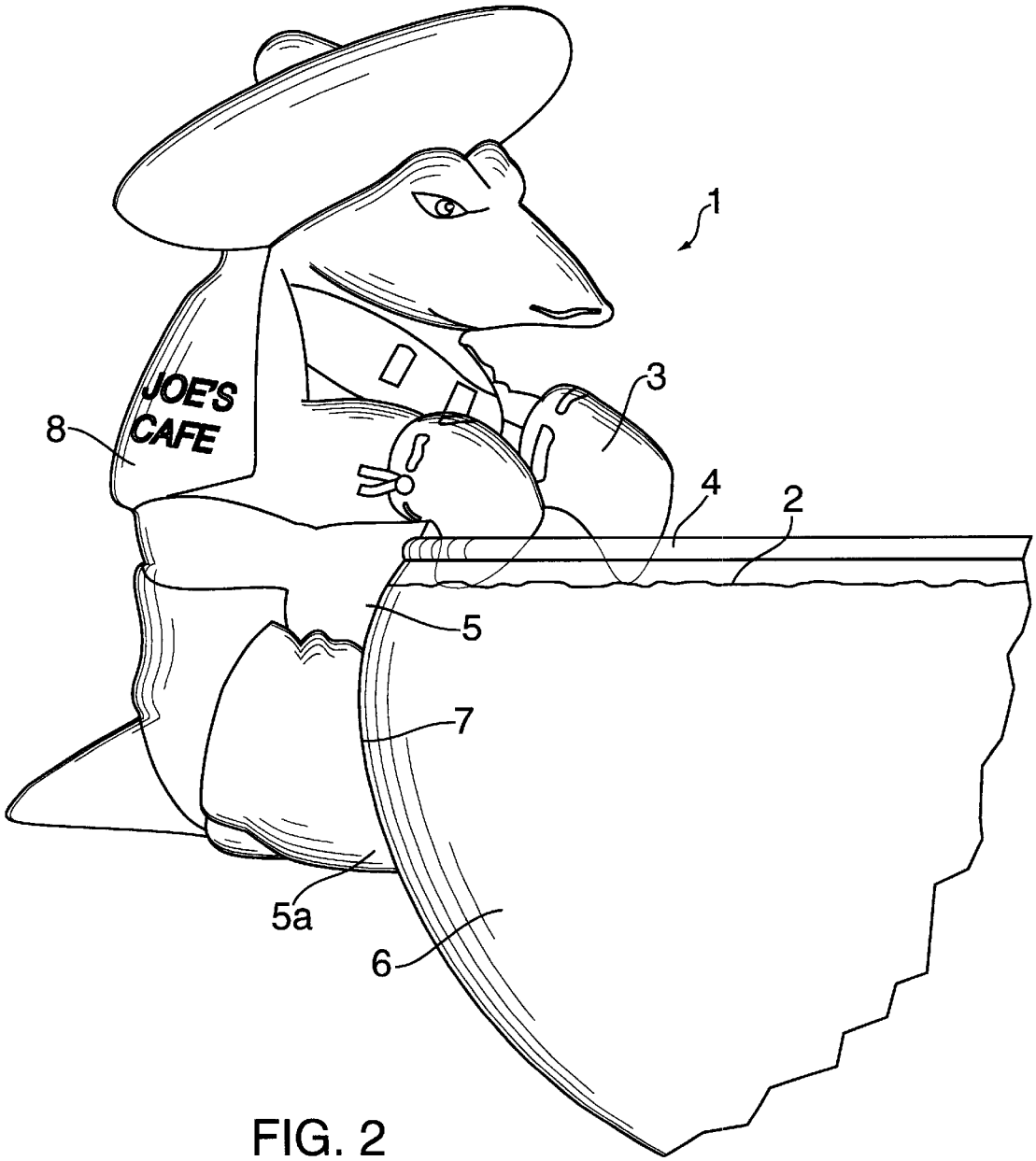
FIG. 2 is the other side perspective view of the figurine of FIG. 1 in accordance with the principles of the present invention.
Figure 3:
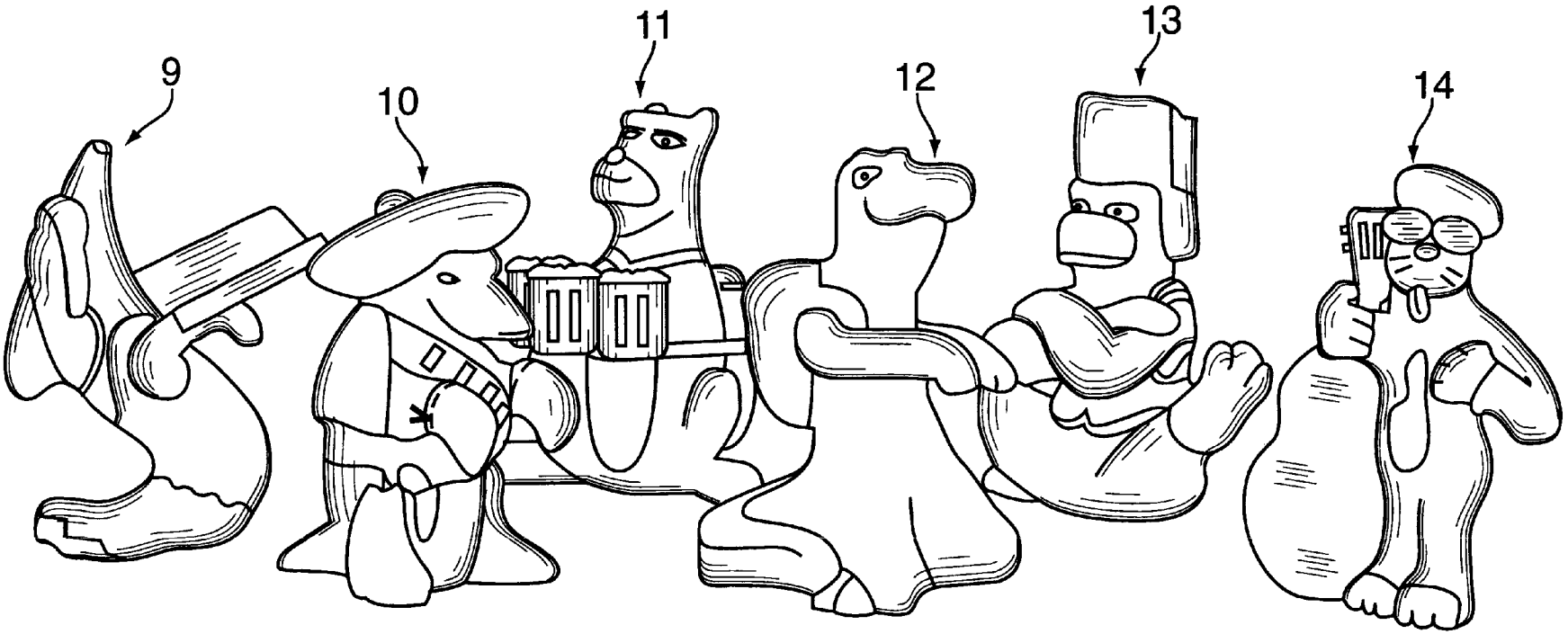
FIG. 3 is an illustration of six variations of the figurine in accordance with the principles of the present invention.

Referring to FIGS. 1 and 2, the promotional product in accordance with the principles of the present invention includes a figurine 1 capable of balancing on a container including a beverage drinking vessel 2, such as a glass or a mug, adjacent a top of the vessel 2. The container could also be a food container. The figurine 1 is custom made to balance on each different type of the beverage drinking vessel and food container. The figurine may be a representation of one of the group consisting of a person, an animal, as shown in FIGS. 1–3, an object and a cartoon character. The figurine may be colored by FDA (Federal Drug Administration) approved paints. This is required since the figurine is employed in an intimate relation with food and drink.

The figurine 1 has at least one limb 3, shown to be two in FIGS. 1 and 2, engaging the rim 4 of the drinking vessel 2. The figurine 1 includes a body part 5 or 5*a* spaced from the rim 3 of vessel 1 contacting a side wall 6 of the vessel 2. As best seen in FIG. 2 the body part 5 is concave to engage a complimentary convex portion 7 of the side wall of vessel 1. Body part 5*a* can be the feet of the figurine or some other part thereof to provide the proper counter weight to enable balancing. The figurine 1 can further include at least one smooth surface 8 upon which one of the group consisting of a logo, a slogan, a message, a tag line, a beverage name, a food name, a company name and an establishment name can be imprinted. As illustrated in FIGS. 1 and 2 there are two smooth surfaces 8 upon which a logo, a slogan, a message, a tag line, a beverage name, a food name, a company name and an establishment name or a combination of these elements can be imprinted.

As shown in FIG. 3, the figurine 1 can assume many different characters, such as a dolphin 9, armadillo 10 (figurine 1 of FIGS. 1 and 2), a bear 11, a lizard 12, a dog 13 or a cat 14. Also, it is to be clearly understood that the figurine 1 can be a representation of a person, an object or a cartoon character in additional to the animals illustrated. The figurine could also be a representation of an object have a slit or the like their to enable balancing the object on the rim of a food container or a beverage drinking container or vessel.

As mentioned hereinabove figurines in accordance with the principles of the present invention are cost effective, are easily molded and are engineered to balance on different ones of drinking vessels 2 or food containers. The figurine can be made from plastic and can be solid or hollow. The main criteria is to be able to balance on a rim of a food or beverage container. Figurines also may be developed for a particular drink, food or beverage type and also for various cultural backgrounds. As mentioned above another important design consideration for the figurines, in accordance with the principles of the present invention, is to provide two clear smooth surfaces upon which the imprinting of a logo, a slogan, a message, a tag line, a beverage name, a food name, a company name and an establishment name or a combination of any of these elements can be provided for promotional purposes.

Figure 4:
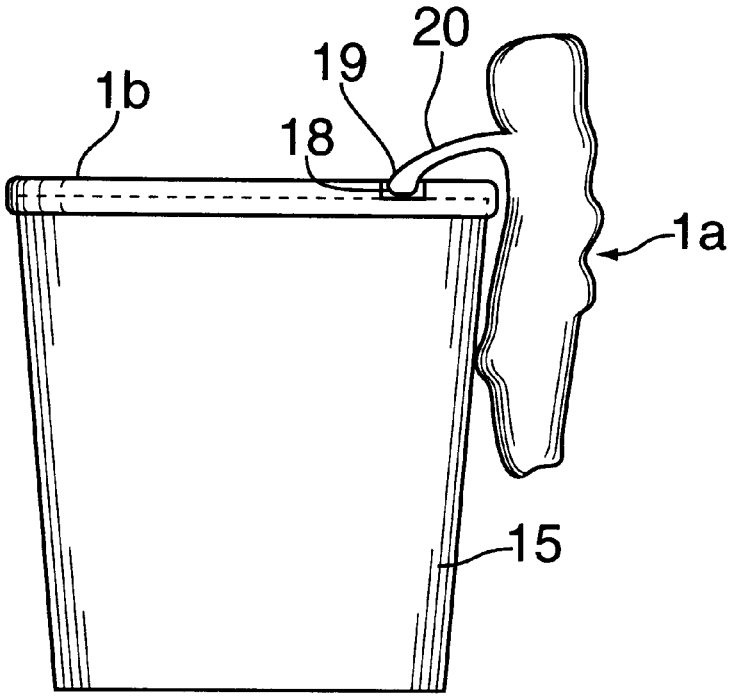
FIG. 4 is a side elevational view of another embodiment of the figurine in accordance with the principles of the present invention.
Figure 5:
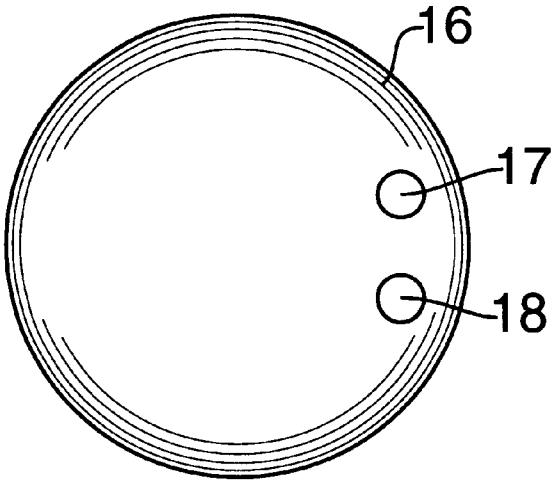
FIG. 5 is a top view of FIG. 4 with the figurine removed.

Referring to FIGS. 4 and 5, another embodiment of the figurine in accordance with the principles of the present invention is illustrated. In this embodiment the food or beverage container 15 is covered by a lid 16 and figurine 1*a* is not only balanced on container 15 adjacent the top thereof, but also holds lid 16 on container 15. To accomplish this lid 16 has depressions 17 and 18 therein that are engaged by balls 19 on the ends of limbs 20 of figurine 1*a*.

Figurine 1 and 1*a* are take away promotional products or toys that can be placed on a desk or computer or the like as a novelty thereby providing continued promotional exposure for the advertiser.

While I have described above the principles of my invention in connection with specific apparatus, it is to be clearly understood that this description is made only by way of example and not as a limitation to the scope of my invention as set forth in the objects thereof and in the accompanying claims.

I claim:

1. A promotional product capable of balancing on a selected one of a beverage drinking vessel and a food container comprising:

a figurine capable of balancing on a top of said selected one of said beverage drinking vessel and said food container, said figurine being custom-made to loosely engage said top of said selected one of said beverage drinking vessel and said food container and bearing against an external surface of a side wall of said selected one of said beverage drinking vessel and said food container, said figurine bearing against said external surface of said side wall at a location spaced from said top of said selected one of said beverage drinking vessel and said food container, said figurine being a representation of a selected one of a person, an animal, an object and a cartoon character;

wherein said figurine includes a body part spaced from said top of said selected one of said beverage drinking vessel and said food container contacting said external surface of said side wall thereof;

wherein said body part is concave to engage a complementary convex portion of said external surface of said side wall.

2. A promotional product according to claim 1, wherein said figurine includes at least one limb engaging a rim of said selected one of said beverage drinking vessel and said food container.

3. A promotional product according to claim 1, wherein said figurine includes two limbs engaging a rim of said selected one of said beverage drinking vessel and said food container.

4. A promotional product according to claim 1, wherein said figurine further includes at least one smooth surface upon which a selected one of a logo, a slogan, a message, a tag line, a beverage name, a food name, a company name and an establishment name can be imprinted.

5. A promotional product according to claim 6, wherein said figurine includes at least one limb engaging a rim of said selected one of said beverage drinking vessel and said food container.

6. A promotional product according to claim 6, wherein said figurine includes at least one limb engaging a rim of said selected one of said beverage drinking vessel and said food container.

7. A promotional product according to claim 1, wherein said figurine further includes at least two smooth surfaces upon which a selected one of a logo, a slogan, a message, a tag line, a food name, a beverage name, a company name and an establishment name can be imprinted.

8. A promotional product according to claim 7, wherein said figurine includes at least one limb engaging a rim of said selected one of said beverage drinking vessel and said food container.

9. A promotional product according to claim 7, wherein said selected one of said beverage drinking vessel and said food container includes a lid, and said figurine includes two limbs engaging said lid of said selected one of said beverage drinking vessel and said food container.

10. A promotional product capable of balancing on a selected one of a beverage drinking vessel and a food container comprising:

figurine capable of balancing on a top of said selected one of said beverage drinking vessel and said food container, said figurine being custom-made to loosely engage said top of said selected one of said beverage drinking vessel and said food container and bearing against an external surface of a side wall of said selected one of said beverage drinking vessel and said food container, said selected one of said beverage drinking vessel and said food container including a lid, and said figurine includes two limbs engaging said lid of said selected one of said beverage drinking vessel and said food container, and a body part spaced from said lid of said selected one of said beverage drinking vessel and said food container contacting said external surface of said side wall of said selected one of said beverage drinking vessel and said food container.

* * * * *